US009332371B2

(12) United States Patent
De Bruijn

(10) Patent No.: US 9,332,371 B2
(45) Date of Patent: May 3, 2016

(54) ESTIMATION OF LOUDSPEAKER POSITIONS

(75) Inventor: Werner Paulus Josephus De Bruijn, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 701 days.

(21) Appl. No.: 13/322,746

(22) PCT Filed: May 27, 2010

(86) PCT No.: PCT/IB2010/052362

§ 371 (c)(1),
(2), (4) Date: Nov. 28, 2011

(87) PCT Pub. No.: WO2010/140088

PCT Pub. Date: Dec. 9, 2010

(65) Prior Publication Data

US 2012/0075957 A1 Mar. 29, 2012

(30) Foreign Application Priority Data

Jun. 3, 2009 (EP) ..... 09161785

(51) Int. Cl.
*H04S 7/00* (2006.01)

(52) U.S. Cl.
CPC ..... *H04S 7/301* (2013.01); *H04R 2205/024* (2013.01); *H04S 7/302* (2013.01)

(58) Field of Classification Search
CPC ..... G10L 19/008; G10L 19/24; G10L 19/167; G10L 19/20; G10L 21/038
USPC ..... 381/80, 17, 305, 306, 59, 58; 367/18–127, 129; 181/187, 30, 138
See application file for complete search history.

(56) References Cited

U.S. PATENT DOCUMENTS 4,944,036 A * 7/1990 Hyatt ..... 367/43
5,991,085 A * 11/1999 Rallison ..... G02B 27/017 345/8

(Continued)

FOREIGN PATENT DOCUMENTS

EP 1651007 A2 4/2006
EP 1408276 B1 * 8/2009 ..... F21V 23/0471

(Continued)

OTHER PUBLICATIONS

Yun et al: "Self-Contained Position Tracking of Human Movement Using Small Intertial/Magnetic Sensor Modules"; 2007 IEEE International Conference on Robotics and Automation, Apr. 2007, pp. 2526-2533.

*Primary Examiner* — Luke Ratcliffe
*Assistant Examiner* — Amienatta M Ndure Jobe

(57) ABSTRACT

A system for determining loudspeaker position estimates comprises motion sensors (201,203) and a movement processor (205) arranged to determine motion data for a user movable unit where the motion data characterizes movement of the user moveable unit. A user input interface (207) receives user inputs and a user processor (209) processes them into user activations which indicate that at least one of a current position and orientation of the user movable unit is associated with a loudspeaker position. An analyzing processor (211) then generates loudspeaker position estimates in response to the motion data and the user activations. The system thus performs speaker position estimations based on (i) the motion data of the user moveable unit being pointed towards or positioned on a speaker and (ii) the user activations.

14 Claims, 3 Drawing Sheets

(56) References Cited

U.S. PATENT DOCUMENTS

| | | | | |
|---|---|---|---|---|
| 6,856,688 | B2 | 2/2005 | Cromer et al. | |
| 6,970,796 | B2 * | 11/2005 | Tashev | 702/94 |
| 7,428,310 | B2 | 9/2008 | Park | |
| 7,453,763 | B2 * | 11/2008 | Johnstad | 367/20 |
| 7,463,250 | B2 * | 12/2008 | Lapstun et al. | 345/179 |
| 7,487,056 | B2 * | 2/2009 | Tashev | 702/94 |
| 8,279,709 | B2 * | 10/2012 | Choisel et al. | 367/127 |
| 2003/0031333 | A1 * | 2/2003 | Cohen et al. | 381/303 |
| 2003/0090476 | A1 * | 5/2003 | Lapstun et al. | 345/173 |
| 2003/0171833 | A1 * | 9/2003 | Crystal et al. | 700/94 |
| 2004/0071294 | A1 | 4/2004 | Halgas, Jr. et al. | |
| 2005/0069153 | A1 * | 3/2005 | Hall et al. | 381/103 |
| 2005/0152557 | A1 * | 7/2005 | Sasaki et al. | 381/58 |
| 2006/0088174 | A1 | 4/2006 | DeLeeuw et al. | |
| 2006/0125786 | A1 * | 6/2006 | Genz | 345/156 |
| 2007/0104341 | A1 * | 5/2007 | Kondo et al. | 381/306 |
| 2007/0133813 | A1 | 6/2007 | Morishima | |
| 2007/0211908 | A1 * | 9/2007 | Van Reck | 381/80 |
| 2008/0174550 | A1 * | 7/2008 | Laurila | A63F 13/02 345/158 |
| 2008/0246830 | A1 * | 10/2008 | Martin | H04N 5/23203 348/14.02 |
| 2008/0254822 | A1 * | 10/2008 | Tilley | 455/550.1 |
| 2009/0123007 | A1 * | 5/2009 | Katayama | 381/300 |
| 2009/0298590 | A1 * | 12/2009 | Marks | A63F 13/02 463/37 |
| 2010/0052571 | A1 * | 3/2010 | Murakami et al. | 315/297 |
| 2010/0135118 | A1 * | 6/2010 | Van Leest et al. | 367/124 |
| 2010/0157738 | A1 * | 6/2010 | Izumi et al. | 367/125 |
| 2010/0323793 | A1 * | 12/2010 | Andall | 463/35 |
| 2012/0289334 | A9 * | 11/2012 | Mikhailov | A63F 13/06 463/33 |

FOREIGN PATENT DOCUMENTS

| | | | |
|---|---|---|---|
| WO | 03088711 | A2 | 10/2003 |
| WO | 2006033074 | A1 | 3/2006 |
| WO | 2006100644 | A2 | 9/2006 |
| WO | 2007004134 | A2 | 1/2007 |
| WO | 2009010832 | A1 | 1/2009 |

* cited by examiner

SYSTEM FOR DETERMINING LOUDSPEAKER POSITION ESTIMATES

ESTIMATION OF LOUDSPEAKER POSITIONS

FIELD OF THE INVENTION

The invention relates to estimation of loudspeaker positions and in particular, but not exclusively to estimation of loudspeaker positions in consumer surround sound systems.

BACKGROUND OF THE INVENTION

Sound systems are becoming increasingly advanced, complex and varied. For example, multi-channel spatial audio systems, such as five or seven channel home cinema systems, are becoming prevalent. However, the sound quality, and in particular the spatial user experience, in such systems is dependent on the relationship between the listening position and the loudspeaker positions. In many systems, the sound reproduction is based on an assumed relative speaker location and the systems are typically designed to provide a high quality spatial experience in a relatively small area known as the sweet spot. Thus, the systems typically assume that the speakers are located such that they provide a sweet spot at a specific nominal listening position.

However, the ideal speaker position setup is often not replicated in practice due to the constraints of practical application environments. Indeed, as loudspeakers are often considered to be a necessary rather than a desired design feature, users (such as private consumers) typically prefer a high flexibility in choosing the number and positions of loudspeakers. For example, in a typical living room, it is often not possible or desired (e.g. for aesthetic reasons) to position a high number of loudspeakers at the positions which result in optimal performance.

Some audio systems have been developed to include functionality for manual calibration and compensation for varying speaker positions. For example, many home cinema systems include means for manually setting a delay and relative signal level for each channel (e.g. by manually indicating the distance to the loudspeakers). However, such manual setting of individual parameters tends to be quite cumbersome and impractical for the typical user. Furthermore, it tends to not provide optimal performance as the parameters that can be set are relatively limited (while still being confusing to many non-experts).

It has also been proposed to perform a semi-automated automation process based on a microphone being placed at the listening position during a calibration process. The audio system may then optimize various characteristics of the signal path for each channel to provide optimized sound at the microphone position. However, although such a process may improve the audio quality it provides relatively limited flexibility as the optimization is only based on the information provided by the microphone, and as such is limited to one listening position and to adaptation of parameters that affect the sound captured by the microphone. For example, it does not provide any direct spatial information that can be used to optimize the system.

Some audio systems comprise functionality for optimizing the audio signal processing based on the actual speaker positions relative to a listening position or area. For example, systems have been proposed that automatically optimize the signal processing to provide the consumer with an optimized spatial sound reproduction for any loudspeaker configuration.

However, in order to optimize the sound reproduction in such a flexible system, it is necessary that the loudspeaker positions and preferably also the listening position and the orientation of the user are determined.

It has been proposed that the speaker positions can be automatically determined based on an acoustical measurement of the loudspeaker outputs. Specifically, it has been proposed that the relative positions of the loudspeakers may be determined by co-locating a microphone with each loudspeaker and with each loudspeaker then in turn playing a calibration signal that is picked up by the microphones of the other loudspeakers. By determining the different propagation delays from each individual loudspeaker to all the other loudspeakers from the captured signals, it is possible to make an estimation of the geometrical lay-out of the speaker setup.

However, such an approach has some associated disadvantages. For example, it requires additional hardware (a microphone) for each loudspeaker thereby increasing cost and limiting the use to systems wherein such microphones are provided with the speakers. Furthermore, it requires communication between the central unit and each of the loudspeakers thereby further increasing complexity and cost. In addition, the sensitivity to acoustical disturbances in the room is relatively high. For example, sound sources other than the loudspeakers or objects blocking the direct path from loudspeaker to microphones may degrade the approach significantly. Furthermore, the method requires a calibration signal to be played, which means the calibration process is noticeable and possibly annoying to the user. Also, in order to determine the listening position it is necessary to position an additional microphone at the listening position.

Another approach that has been proposed is RF (Radio Frequency) based localizing methods, such as RFID (Radio Frequency IDentification) and Ultra-wideband (UWB). These methods use tags that are attached to the objects to be localized. The tags emit a low-power RF signal which is detected by multiple (>=3) RF sensors, after which the relative location is determined by triangularization. However such an approach also has some associated disadvantages. In particular, each object to be localized needs to be tagged, multiple sensors are required and these need to be spatially distributed across the room, and the indoor-accuracy is often relatively low and insufficient for adapting audio systems to speaker configurations. Furthermore, the approach is relatively expensive as the cost of the associated technology is relatively high.

Furthermore, a common problem for most currently proposed approaches is that they are not easily extended from determining a speaker position to determining a position of a listener. For example, it is inconvenient to have to place and RFID sensor at a listening location.

Hence, an improved system for estimating speaker positions would be advantageous and in particular a system allowing increased flexibility, improved audio quality, reduced cost, facilitated operation, facilitated implementation, an improved user experience, an improved spatial perception and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided system for determining loudspeaker position estimates, the system comprising: means for determining motion data for a user movable unit, the motion data characterizing movement of the user moveable unit, and a user input for receiving user activations, a user activation indicating that at least one of a current position and orientation of the user movable unit is associated with a loudspeaker position when the user activation is received; and analyzing means for generating loudspeaker position estimates in response to the motion data and the user activations.

The invention may allow an efficient estimation of speaker positions. In particular, a relatively high accuracy can be achieved while maintaining a very low complexity and/or user friendly approach. The approach may be used in many different scenarios and is applicable to many different speaker setups and audio environments.

The approach may be particularly suitable for the consumer segment as it allows reliable speaker position determination based on simple operations and a measurement procedure that is easy to perform by a non-expert.

The invention may allow a low cost approach and in particular avoids a necessity of separate measurement equipment co-located with or built into all individual loudspeakers. Indeed, the approach may be completely independent of any specific speaker being used. Indeed, the speaker positions may be estimated without any speakers being positioned at all, and the approach may e.g. be used for a pre-calibration of a system prior to the actual installment of the speakers.

Also, the system does not require any communication exchange between any of the loudspeakers and the estimation functionality. Indeed, in many embodiments any communication of data associated with the speaker position estimation is limited to a communication of data from the user movable unit The approach may in many scenarios provide an improved direct assessment of the relative positions of speakers for a given listening position and does not rely on more complex, inaccurate, or error prone estimation indirect algorithms such as e.g. triangularization or least-squares estimation algorithms. Furthermore, the approach does not necessitate any direct line of sight and may be insensitive to interference, such as radio interference or audio interference.

Also, low cost implementations can be achieved and in particular the approach may allow that speaker position estimates are based on data from low cost motion sensor technology, such as low cost MEMS (Micro Electro-Mechanical System) motion sensors.

The orientation of the moveable unit may include any indication of a relative or absolute direction of the moveable unit and/or any indication of a rotation of the moveable unit around any physical or analytical axis. The position and orientation of the user movable unit may include any indication of a relative or absolute position, alignment, direction, rotation, angle or attitude of the user movable unit.

The motion data may for example be generated by one or more motion sensors in the user moveable unit. In some embodiments, the means for determining motion data may be comprised in the user movable unit. In some embodiments, the user input may be comprised in the user movable unit. In some embodiments, the analyzing means may be partially or fully comprised in the user movable unit.

The loudspeaker position estimates may be used to modify a characteristic of the rendering or presentation of sound from the loudspeaker positions. For example, the loudspeaker positions may be associated with loudspeakers of a multi-channel spatial sound system, such as a surround sound system. The loudspeaker position estimates may correspond to the spatial channel loudspeakers presenting the signals of the individual channels of the multi-channel signal. The system may include means for modifying a characteristic of the presentation of the multi-channel signal from loudspeakers associated with the estimated loudspeaker positions in response to the estimated loudspeaker positions. The use of accurate loudspeaker position estimates provide a much increased flexibility and scope for optimizing the presentation of the multi-channel signal.

In accordance with an optional feature of the invention, the analyzing means is arranged to determine orientation data indicative of an orientation of the user movable unit in response to the motion data.

This may provide improved estimation and/or facilitated operation in many scenarios. The orientation may include an angle, direction and/or rotation of the user movable unit.

In accordance with an optional feature of the invention, the analyzing means is arranged to estimate a direction from a position to a loudspeaker for each of a plurality of user activations in response to orientation data for the user activations; and to determine the loudspeaker position estimates in response to the directions.

This may provide improved estimation and/or facilitated operation in many scenarios. In particular, the direction may be represented by an angle relative to a reference direction. The reference direction may correspond to a direction towards a central point of symmetry for the speaker setup, and/or a predetermined spatial sound perception angle—such as the angle directly in front of the listener.

The position may be any position in three-dimensional, two-dimensional or even one dimensional space. The position may in many applications be the listening position. The position may be a position corresponding to the position of the user movable unit when receiving one or more of the user activations or may e.g. be determined from these positions (e.g. as an average).

In accordance with an optional feature of the invention, the analyzing means is arranged to determine the loudspeaker position estimates in response to a predetermined distance estimate from the position to each loudspeaker position.

This may allow a facilitated loudspeaker position estimation process while providing results that are sufficiently accurate for many scenarios, applications and speaker setups.

The predetermined distance may be the same for all loudspeakers or may be different for different speakers. The predetermined distance may be a fixed distance, e.g. set at the design phase or manually entered by a user. Thus, the predetermined distance may be any non-measured distance.

In accordance with an optional feature of the invention, the analyzing means is arranged to determine position data indicative of a position of the moveable unit in response to the motion data.

This may provide improved estimation and/or facilitated operation in many scenarios. The orientation may include an angle, direction and/or rotation of the user movable unit. The position data may e.g. be generated from movement data. E.g. acceleration data may be integrated twice to provide position data. The positions of the user movable unit associated with user activations may be determined. The positions may be determined as absolute or relative positions, e.g. relative to a listening position.

In accordance with an optional feature of the invention, the analyzing means is arranged to estimate a relative position of the user movable unit for each of a plurality of user activations in response to the position data associated with the user activations; and to determine the loudspeaker position estimates in response to the relative positions.

This may provide a low complexity estimation process while providing estimates that are highly suitable for optimization of the presented sound.

In accordance with an optional feature of the invention, the loudspeaker position estimates are determined assuming each relative position corresponds to a loudspeaker position.

This may provide improved estimation and/or facilitated operation in many scenarios. In particular, it may allow an improved optimization of the presented sound from loudspeakers located at the estimated positions.

In accordance with an optional feature of the invention, the user input is arranged to receive a reference user activation indicating that a current position or orientation of the user movable unit is associated with a listening position reference, and the analyzing means is arranged to determine a reference position or orientation in response to the reference user activation, and to determine the speaker position estimates in response to the reference position or orientation.

This may allow an improved optimization of the rendering of sound from the estimated speaker positions and may in particular allow an optimization for a specific and user selectable/definable listening position.

In accordance with an optional feature of the invention, the analyzing means is arranged to determine the speaker position estimates relative to the listening position.

This may facilitate and/or improve the estimation and/or optimization of the rendering of sound from the estimated speaker positions.

In accordance with an optional feature of the invention, the user input is arranged to receive a user input indicating that a loudspeaker position is unused; and the analyzing means is arranged to designate a corresponding speaker position as unused.

This may provide a high flexibility and/or an improved adaptation while allowing a simple and user friendly calibration process. In particular, the rendering of sound may be adapted to the exact number and the estimated positions of the loudspeakers used.

In accordance with an optional feature of the invention, the user moveable unit is a handheld device.

This may provide a highly flexible and user friendly approach and may be particularly advantageous in the consumer segment. The handheld device may specifically be a remote control. The remote control may be a remote control capable of controlling a user device. Specifically, the remote control may be a remote control for a loudspeaker drive unit (such as an amplifier) for driving loudspeakers associated with the estimated loudspeaker positions. Thus, the approach may allow a standard remote control provided for controlling the sound system to also be used for an accurate calibration of speaker positions.

In accordance with an optional feature of the invention, the user moveable unit is arranged to determine at least one of a position estimate and an orientation estimate for the user moveable unit at a time of user activation; and the user moveable unit further comprises means for communicating the at least one of the position estimate and the orientation estimate to a remote unit.

This may provide an efficient approach in many embodiments and may in particular reduce the amount of data being communicated from the user moveable unit thereby reducing battery usage etc. The user movable unit may in particular not be required to communicate raw motion data or data characterizing the individual user activations.

In accordance with an optional feature of the invention, the user moveable unit comprises a motion detection sensor and the determining means is arranged to determine the motion data in response to data from the motion detection sensor, the motion detection sensor comprising at least one of: a gyroscope; an accelerometer; and a magnetometer.

This may provide improved and/or facilitated operation or complexity/cost.

In accordance with an optional feature of the invention, the system further comprises means for causing a sound signal to be radiated from a first loudspeaker position to be estimated; and means for linking a user activation received within a time interval associated with the sound radiation to the first loudspeaker position.

This may assist a user in performing an accurate calibration.

According to an aspect of the invention there is provided a method of determining loudspeaker position estimates, the method comprising: determining motion data for a user movable unit, the motion data characterizing movement of the user moveable unit, and receiving user activations, a user activation indicating that at least one of a current position and orientation of the user movable unit is associated with a loudspeaker position when the user activation is received; and generating loudspeaker position estimates in response to the motion data and the user activations.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to speaker position estimation in a home cinema surround sound system. However, it will be appreciated that the invention is not limited to this application but may be applied to speaker position estimation in many other sound systems.

Figure 1:
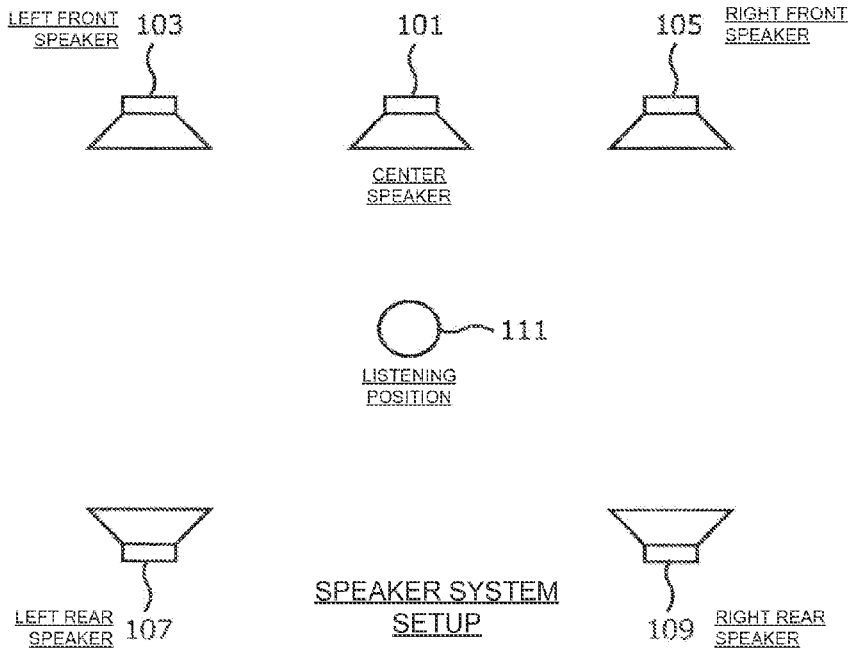
FIG. 1 illustrates a speaker system setup in a conventional five channel surround sound system.

FIG. 1 illustrates a speaker system setup in a conventional five channel surround sound system, such as a home cinema system. The system comprises a center speaker 101 providing a center front channel, a left front speaker 103 providing a left front channel, a right front speaker 105 providing a right front channel, a left rear speaker 107 providing a left rear channel, a right rear speaker 109 providing a right rear channel. The five speakers 101-109 together provide a spatial sound experience at a listening position 111 and allow a listener at this location to experience a surrounding and immersive sound experience. In many home cinema systems, the system further provides a subwoofer for a Low Frequency Effects (LFE) channel.

However, in practical scenarios it is often not possible or convenient to position the loudspeakers at the ideal locations. Indeed in practical systems, the actual position of the speakers may vary very substantially. This may have a very substantial impact on the sound perception at the listening position and in particular may significantly affect the spatial perception. In order to compensate for speaker variations, the sound system may include compensation that is specifically adapted to the actual speaker positions. However, such approaches depend on an accurate estimation of the speaker locations in order to provide appropriate compensation.

Figure 2:
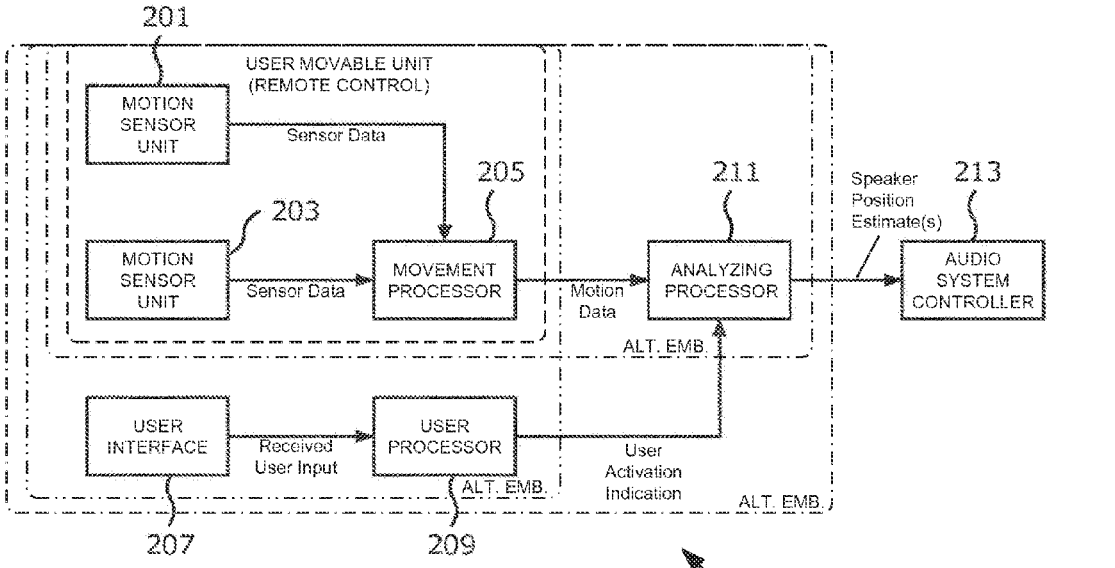
FIG. 2 illustrates an example of elements of a system for estimating speaker positions in accordance with some embodiments of the invention.

FIG. 2 illustrates a system for estimating loudspeaker positions in accordance with some embodiments of the invention.

The system is based on using motion sensors in a user movable unit to provide motion data. The system further receives user activations, such as key presses, which indicate that the current position or orientation of the user movable unit is linked to a speaker position, i.e. that these provide an indication of a speaker position. For example, a button may be pressed when the user movable unit is pointing towards, or is on top of, one of the loudspeakers.

The system then calculates the speaker positions from the movement data and the user activations. For example, the user movable unit may be located at a loudspeaker position or may be pointed towards a loudspeaker position when the user activation is received. The direction or the position of the user movable unit may then directly be calculated at this instant and may be used as an indication of the loudspeaker position (or indeed may directly be used as the position of the speaker).

Specifically, in the system, motion sensors are integrated in a small hand-held device (e.g. the remote control of the home cinema system) and these sensors are used to determine the positions of the loudspeakers relative to the listening position, as well as the orientation of the user relative to the loudspeaker set-up. Specifically, the user is instructed to sequentially point the user movable unit towards the loudspeakers from his listening position or to position the user movable unit next to or on top of the loudspeakers. These determined loudspeaker positions (and optionally the listening position and/or user orientation) are then used to optimize the spatial sound reproduction of the loudspeaker system e.g. by applying a suitable re-mapping of the audio signals In the example of FIG. 2, the user movable unit comprises a first and second motion sensor unit 201, 203 which generates motion data characterizing movement of the user moveable unit. It will be appreciated that in other embodiments, fewer or more sensors may be used. Each of the motion sensors 201, 203 may specifically include one or more MEMS sensors such as a gyro, an accelerometer, or a magnetometer.

A variety of MEMS motion sensors are available and tend to be small, low complexity and low cost thereby making them suitable for use in almost any device including even small low cost portable devices. Also, the accuracy of such sensors is relatively high and continuously improving.

Different types of MEMS sensors exist including:

- Accelerometers which measure linear acceleration in 1, 2, or 3 dimensions.
- Gyroscopes which measure angular rate of change in 1, 2 or 3 dimensions.
- Magnetometers which measure angular orientation relative to magnetic north.

The first and second motion sensor unit 201, 203 are coupled to a movement processor 205 which receives the generated sensor data. The movement processor 205 is furthermore coupled to an analyzing processor which is fed the motion data derived or received from the sensor units 201, 203.

In addition, the system comprises a user interface 207 which is arranged to receive an input from a user. The user interface may for example include one or more keys or buttons that can be pressed by a user. The user interface 207 is coupled to a user processor 209 which is arranged to detect if any user input is received. Specifically, the user processor 209 may detect if the user presses a key or button. The user processor 209 is further coupled to the analyzing processor 211 which is provided with an indication of a user activation whenever a user input is detected. Specifically, whenever a user presses a key or button, the user processor 209 generates a user activation indication and feeds it to the analyzing processor 211.

The analyzing processor 211 is arranged to estimate one or more speaker positions based on the received motion data and the user activations. For example, the analyzing processor 211 may continuously estimate a position of the user movable unit and may capture the current position when a user activation is received. It may then use this position directly as an estimated speaker position. As another example, the analyzing processor 211 may continuously detect a direction of the user movable unit and may capture the current direction when a user activation is received. The analyzing processor 211 may then proceed to estimate the speaker position relative to the current location of the user movable unit (which may be assumed to be at the listening position 111) based on the direction and e.g. a predetermined fixed assumed distance to the speaker position.

In the example, the analyzing processor 211 is coupled to an audio system controller 213 which is arranged to control the operation of an audio system that renders audio from speakers associated with the speaker positions. The audio system may for example be a home cinema amplifier which is driving a set of loudspeakers associated with (assumed to be located at) the estimated speaker positions. The audio system controller 213 may control the operation of the audio system such that it adapts to the specific estimated positions of the speakers of the audio system.

For example, a delay and/or level for each speaker may be set depending on the estimated distance from the speaker to the listening position. Furthermore, as the exact estimated position for each speaker is known, substantially more complex and flexible adaptations may be used. For example, the audio system controller 213 may determine that one or more of the loudspeakers is more likely to degrade than enhance the spatial experience and may accordingly disable this from being used. The audio system may then be optimized for the scenario where the corresponding expected speaker position is not used. For example, if a surround speaker is too close to a listening position it may be disabled.

As another example, the estimated speaker position may be used to provide an enhanced spatial signal by providing a flexible distribution of different audio channels over the specific speakers. For example, the speaker position estimates may indicate that the front left speaker 103 and the right front speaker 105 are positioned very close to the center speaker 101 whereas the left surround and the right surround speakers 105, 107 are positioned to the side of rather than behind the listener (e.g. because the listening position corresponds to a sofa located up against a back wall thereby preventing rearwards surround speakers). In such a situation, a traditional surround system will provide a relatively compressed spatial experience. However, based on the loudspeaker position estimates, the audio system controller 213 may control the home cinema amplifier to render the left front channel through both the left front speaker 103 and the left surround speaker 107. This may provide a perceived position for the left front channel between the left front speaker 103 and the left surround speaker 107, with the exact position being adjustable by the exact distribution of the left front channel over the two loudspeakers. The same approach may be applied to the right front channel thereby providing an improved and enhanced spatial experience.

It will be appreciated that the use of the loudspeaker position estimates is not limited to an adaptation or optimization of the audio system operation. For example, in some embodiments, the system may evaluate if the determined loudspeaker positions meet a suitable set of criteria and may provide a user indication if this is not the case. For example, the system may detect any loudspeakers that are considered too close to the listening position and may indicate that these should be moved further away or may e.g. detect a speaker setup which is not sufficiently symmetric to provide a suitable spatial sound experience and may accordingly indicate that speakers should be moved to provide this.

The functionality of FIG. 2 may be freely distributed in the system.

Typically the first and second motion sensor units 201, 203 are located in the user movable unit as is typically the movement processor 205. Thus, the underlying raw motion data is typically generated in the user movable unit.

The user interface 207 and the user processor 209 may in many embodiments also be comprised in the user movable unit as this may provide a practical user experience in many scenarios. For example, the user may move the user movable unit such that it represents or indicates a speaker position and may then simply press a button on the user movable unit to indicate this. However, in some embodiments, the user interface 207 and the user processor 209 may not be part of the user movable unit but may be part of another device. For example, in some embodiments, the user interface 207 and the user processor 209 may be comprised in the audio system driving the loudspeakers, e.g. it may be part of a home cinema amplifier.

The analyzing processor 211 may in some embodiments be fully comprised in the user movable unit, in other embodiments it may be entirely outside the user movable unit, and in yet other embodiments it may be partially implemented in the user movable unit.

For example, in some embodiments, the user movable unit may comprise only the first and second motion sensor units 201, 203 and the movement processor 205 may comprise a communication function for communicating the raw motion data to e.g. the audio system amplifier. The audio system amplifier may receive the raw motion data and may comprise the user interface 207 and the user processor 209 as well as the analyzing processor 211. Thus, whenever a button is pressed on the audio system amplifier, it proceeds to determine data for the corresponding speaker position as indicated by the motion data for the user movable unit. An advantage of such an embodiment is that it may allow for a very simple and low complexity user movable unit.

In a similar embodiment, the user movable unit may comprise the user interface 207 and the user processor 209 but may simply communicate whenever a user activation is received. Thus, in this example the user processor 209 may comprise a communication function for communicating the user input data to e.g. the audio system amplifier. The audio system amplifier may implement the analyzing processor 211 which determines the speaker position estimates based on the raw motion data and the user activations. An advantage of such an implementation is that it may result in a low complexity user movable unit and in particular it does not require any computational resource to be available in the user movable unit.

As another example, the analyzing processor 211 may be fully implemented in the user movable unit such that the user movable unit itself calculates the speaker position estimates which may then be communicated e.g. to an audio system amplifier. This may reduce the communication requirement for the user movable unit substantially and may allow the user movable unit to be used with e.g. existing amplifiers that can adapt performance to specific speaker locations but itself does not have functionality for estimating the positions.

It will be appreciated that many other implementations and variants are possible. For example, in some scenarios, the user movable unit may itself calculate a direction associated with each user activation and may communicate this to an audio system amplifier which then proceeds to determine the speaker locations depending on the provided directions. Thus, in such an implementation, the analyzing processor 211 will be distributed across the user movable unit and the audio system amplifier. It will be appreciated that in such an example, only the directions need to be communicated (e.g. neither the raw motion data nor the user activations need to be communicated). Thus, in many scenarios, such an intermediate approach may provide an advantageous trade-off between e.g. computational and communication resource requirements. It will be appreciated that the same approach can readily be used for user activation related positions of the user movable unit.

In the following, various examples will be provided wherein the user movable unit is a handheld device and specifically is a remote control. The use of a remote control may be particularly advantageous as it already comprises some of the required functionality, such as e.g. a user interface, communication functionality and computational resource. Furthermore, it is often already required for controlling the audio system and therefore the cost of providing the additional speaker location estimation functionality may be kept very low. It is also user friendly as the user does not need an extra device but can simply be provided with additional functionality from the already provided device. The remote control may specifically be a remote control for the audio system amplifier.

As an example of the operation of the system, the estimation may be based on a determination of a position of the remote control from the motion data when a user activation is received. For example, the first and second sensors 201, 203 may include accelerometers that provide motion data which is continually integrated twice by the remote control to provide a continuous position estimate for the remote control. The user may then be instructed to sequentially place the remote control on top of the loudspeakers in the system and press a button. The position when a button is pressed is captured and considered to correspond to the estimated speaker position.

The process may in particular be performed relative to a listening position. For example, the estimation process may be started by the user occupying the listening position and pressing a button. This may reset the calculated position. Thus, the listening position may be a reference position relative to which the speaker positions are determined. The user may then move to the first speaker. The position change is tracked by accelerometers that provide acceleration data which is integrated twice to provide a position estimate relative to the listening position. When the remote control is placed on top of the first speaker, a button is pressed and the current calculated position is captured for that speaker. The user may then proceed to the next speaker and press the button, and this may be repeated for all speakers. Thus, the analyzing processor 211 may estimate a relative position of the remote control for each user activation based on the position data for the user activation. The loudspeaker position estimates are then determined from these relative positions. In particular they may be determined directly as these positions i.e. the relative positions associated with each user activation (keypress) may be assumed to correspond directly to a loudspeaker position.

In this example, the positions are thus determined relative to a listening position. This listening position is determined as the position of the remote control when a reference user activation is received indicating that the remote control is located at the listening position. This reference user activation may e.g. be a dedicated key-press (e.g. of a dedicated button) or may e.g. be a user activation at a specific time, such as e.g. the first or last user activation of the calibration process.

Figure 3:
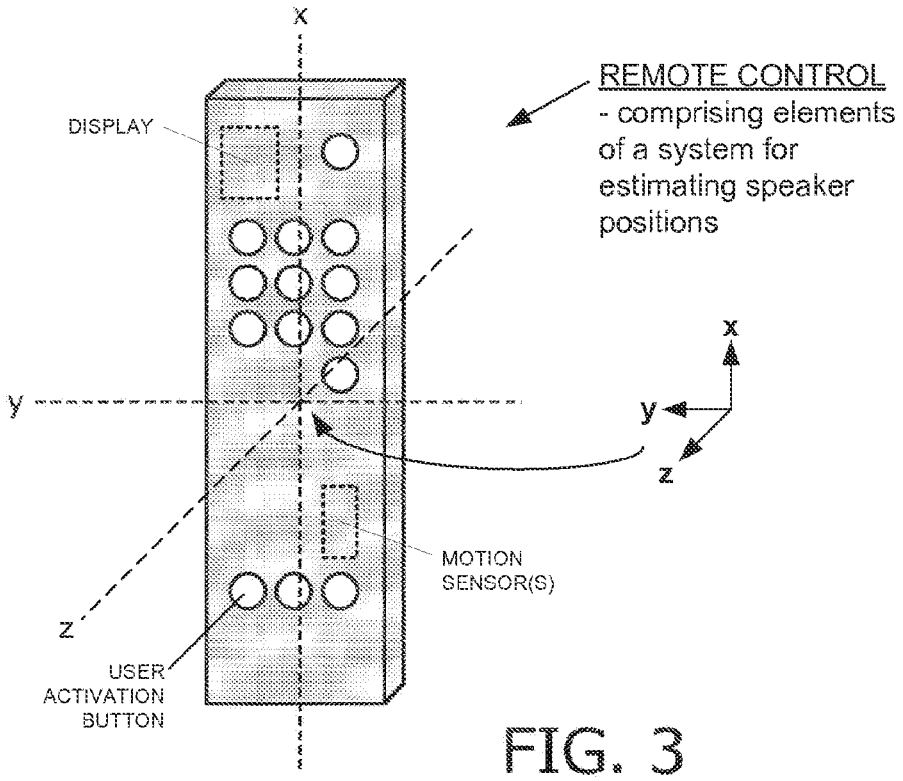
FIG. 3 illustrates an example of a remote control comprising elements of a system for estimating speaker positions in accordance with some embodiments of the invention.

As a specific example, FIG. 3 illustrates a remote control for which two directions x,y are defined. The remote control may include motion sensors in the form of at least one dual-axis accelerometer which measures acceleration in the remote controls x-y plane. In this scenario, a user seated at the desired listening position may first be instructed to point the remote to a reference direction, which most naturally should be the user's dead-front direction, or maybe the direction of an associated display, and press a button. This sets this direction as a reference direction. In addition, it may set the current position to the reference position (e.g. it may reset the values of integrators for the x and y axis accelerometers).

In the specific example it is assumed that the user holds the remote in the same orientation during the whole procedure, i.e. that the user is instructed to not rotate the remote control around any of its axes. It is also assumed that all loudspeakers and the listening position are at the same height.

The user is then instructed to walk with the remote towards the first loudspeaker.

Different approaches may be used to specify which loudspeaker is to be indicated first, for example simply by an instruction manual specifying a sequence for the calibration or e.g. a display on the remote control indicating the next speaker to move to.

As a specific example, the system may be arranged to radiate a sound signal (only) from the loudspeaker at the loudspeaker position which is currently being estimated. This signal may then indicate that the user should walk towards this loudspeaker. The system may then link a user activation received within a time interval associated with the sound radiation to this specific loudspeaker position. For example, if a button is pressed during the time when a speaker is radiating a test signal, this button press is taken to indicate that the remote control is located on top of this speaker. The system may then proceed to radiate sound from the next speaker in the sequence.

While the user is walking towards the next loudspeaker to estimate, the remote control's trajectory is tracked by the accelerometers and the acceleration data is integrated twice to provide a current position in the x-y plane. When the user reaches the position of the loudspeaker, he places the remote control on the loudspeaker and presses a button. This user activation causes the current position to be captured for the loudspeaker.

The user is then instructed to walk towards the next loudspeaker, place the remote control on top of this speaker, and press the button again. This procedure is repeated until all loudspeaker positions have been determined.

At the end of this procedure, the positions of all loudspeakers relative to each other, as well as to the listening position and the orientation of the user have been captured.

The tracking of the remote control's movements and the determination of the positions may for example be based on the raw sensor data being recorded as function of time during the whole procedure, along with the time instants of the button presses, and the computation of the physical trajectory of the remote control as well as the loudspeaker positions may then be calculated after the calibration procedure has finished, e.g. by another unit than the remote control. As another example, the loudspeaker positions may directly be determined from the sensor data during the calibration procedure and only the determined positions themselves may be stored.

In the example, the calculation of the trajectory from the raw accelerometer data basically involves a double integration of the accelerometer data. Such an approach is useful for accelerometers that are sufficiently accurate. However, many low cost MEMS-based accelerometers may suffer from drift problems causing the double integration to result in a growing inaccuracy over time. Indeed, the double integration may result in the position estimate errors possibly growing relatively quickly. Accordingly, in some embodiments a compensation for this drift may be included. In particular, the fact that the velocity of the remote control should be zero whenever a button is pressed may be used to determine and apply a correction factor for the drift. Thus, in addition to serving as a marker for the loudspeakers in the trajectory, the instants at which a button is pressed can also be used as reference points for correcting the recorded data from the accelerometers. A specific example of determining suitable correction factors may e.g. be found in the article "Self-contained position tracking of human movement using small inertial/magnetic sensor modules" by Yun et. al (2007 IEEE International Conf. On Robotics and Automation, April 2007.).

In the specific example, a single dual-axis accelerometer was used and it was assumed that the remote control is always held in the same orientation during the procedure and that all loudspeakers and the listening position are at the same height. However, this assumption may not be appropriate in all embodiments. Therefore, in some embodiments rotation of the remote control along any of its axes may be allowed resulting in a more natural human motion as well as allowing accurate calibration of loudspeakers at different heights. This may be achieved by adding suitable sensors, such as a single-, dual-, or tri-axial gyroscope, an accelerometer measuring acceleration in the z-direction (or of course by replacing the dual-axis one of the first embodiment with a tri-axial one), and/or a magnetometer.

In some embodiments, the speaker position estimates are not based on the position of the remote control when a user activation is received but rather is based on an orientation of the remote control at such a time. Specifically the speaker positions may be estimated based on the directions of the remote control when the user activations are received.

Specifically, the system may estimate a direction from a position towards a loudspeaker when a button is pressed. The position may specifically be the listening position and the direction may be the direction of a suitable axis of the remote control. For example, a user may be occupying the listening position and aim the remote control in the direction of a loudspeaker. When the user presses the button, the current orientation of the remote control is determined from the motion data. For example, the direction of the X-axis of the remote control may be determined relative to a reference direction. The reference direction may be determined by the listener pointing the remote control in the desired reference direction (e.g. directly in front) and pressing a reference direction button. The movement of the remote control between the two directions may be tracked by the motion sensors and used to determine the directions in the two situations. As a specific example, when a user activation is received, the remote control may proceed to determine the relative angle between the current direction of the remote control and the direction when the reference user activation was received.

The approach may be repeated for all loudspeakers, e.g. the user may proceed to sequentially point the remote control in the direction of all loudspeakers and press a button (while remaining in the same location). The speaker positions may then be determined from these directions, for example by assuming that each of the loudspeakers are located in the direction of the remote control and at a predetermined distance (e.g. 3 meters for a front speaker, 3.5 meters for right front and left front speakers and 2 meters for surround speakers).

As a low complexity example, the remote control may comprise a single-axis gyroscope measuring an angular rate of the remote control around the vertical z-axis (perpendicular to the X-Y plane of FIG. 3). Thus the angular rate in the horizontal plane is measured if the remote is oriented parallel to the ground plane.

In this example, it is assumed that only the angles of the individual loudspeakers relative to the user are necessary (as well as possibly the orientation of the user). This implies that it is assumed that all loudspeakers are positioned at a known or sufficiently reliably estimated or assumed distance from the remote control when performing the calibration. E.g. it may be assumed that the speakers are more or less at an equal distance from the listener position in a plane parallel to the ground plane, i.e. that they are more or less arranged on a circle around the listening position.

The user, when seated at the desired listening position, is then first instructed to point the remote control to a reference direction, which typically may be the user's dead-front direction, and then press a button to provide a reference user activation indication. This sets this direction as the reference direction.

Then, the user is instructed to point the remote control towards the first loudspeaker (e.g. in accordance with a predetermined sequence provided to the user through a display or user manual). While the user moves the remote control to point it towards the loudspeaker, the remote control's rotation motion is tracked by the gyroscope. Then, while pointing towards the first loudspeaker, the user presses the button again. Then, the user is instructed to point towards the second loudspeaker, and to press the button when he is pointing towards this. This procedure is repeated until all loudspeaker angles have been determined.

At the end of this procedure, the angles of all loudspeakers relative to each other, as well as to the orientation of the user, are known. The position may then be determined from the assumed distance. Alternatively or additionally, the user may manually input distances to the speakers, or other distance measurement techniques may be used to determine the distance. For example, in order to measure the distance to each loudspeaker, the remote control may e.g. comprise a microphone. An audio signal may then in turn be radiated from each speaker and may be used to determine the distance to the speaker (e.g. using audio ranging techniques).

Alternatively to the use of a gyroscope, the tracking of the azimuth pointing direction may be achieved by two 2-axis (x-y) accelerometers separated by some distance (for example top and bottom edge of the remote control). Although a single accelerometer is not able to detect rotation, it is possible to determine rotation from analyzing the difference between the outputs of two 2-axis accelerometers (for pure translational movement of the remote, the outputs of the two accelerometers will be identical, while for a rotation around a point in between the two accelerometers, their outputs will have opposite signs for both axes).

Figure 4:
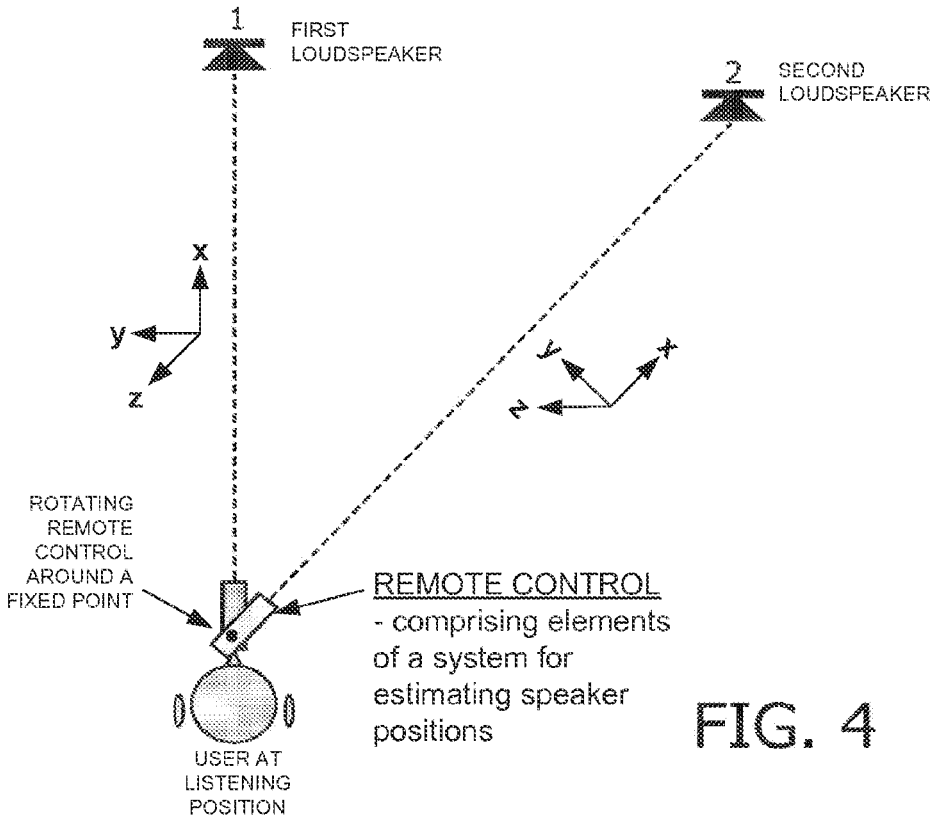
FIG. 4 illustrates an example of use of a remote control comprising elements of a system for estimating speaker positions in accordance with some embodiments of the invention.
Figure 5:
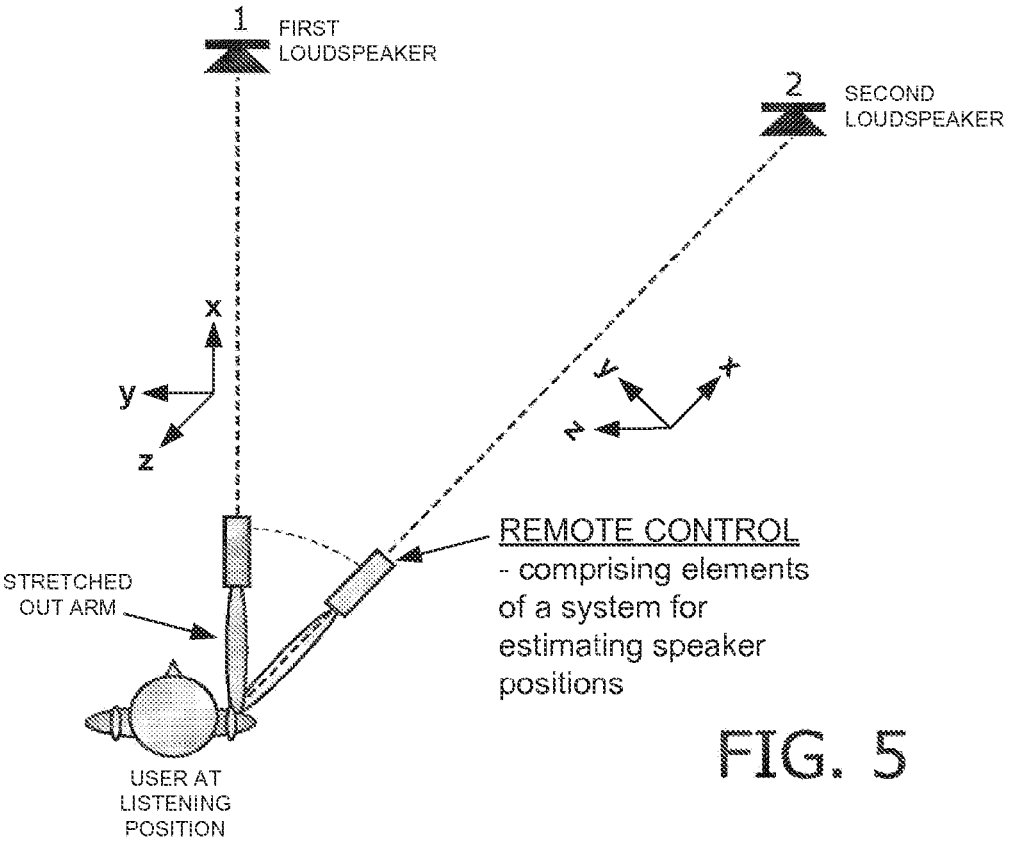
FIG. 5 illustrates an example of use of a remote control comprising elements of a system for estimating speaker positions in accordance with some embodiments of the invention.

For a highly accurate position determination the pointing of the remote control in these examples is performed by purely rotating the remote around a fixed point that is as close as possible to the listening position, e.g. such that the remote control is rotated without the position of the sensor (or the midpoint of the sensors) being changed. Such an example is illustrated in FIG. 4. However, it may also be the case in scenarios wherein a pure rotation is achieved around a single reference point but with the remote control not being at this reference point. For example, such a pure rotation can be achieved by the remote control being held-out by a stretched-out arm which is maintained stretched-out during the procedure. Such an example is illustrated in FIG. 5 which also illustrates how the fixed rotation point is the point where the arm connects to the shoulder (and thus the speaker positions will be determined relative to this point).

Figure 6:
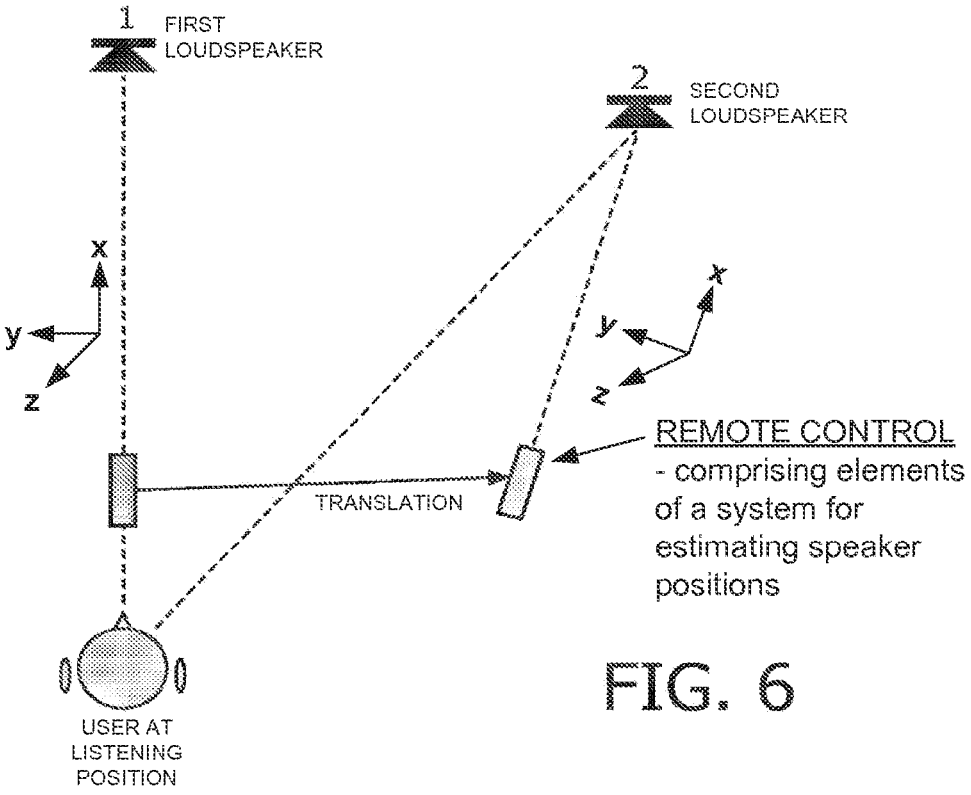
FIG. 6 illustrates an example of use of a remote control comprising elements of a system for estimating speaker positions in accordance with some embodiments of the invention.

However, in situations wherein a pure rotation is not achieved, e.g., if the remote control is moved in the left-right or the front-back direction, or if it is rotated around its own z-axis at a considerable distance from the listening position, the determined angle change may deviate from the correct value. Such an example is illustrated in FIG. 6.

The inaccuracy may depend on the amount of translation of the remote control and the distance of the loudspeakers from the remote control. Furthermore, the error can be eliminated or mitigated by adding 2-axis accelerometers that measure acceleration in the horizontal x-y plane of the remote control and/or a magnetometer. Such approaches may allow both rotation and translation of the remote control to be tracked during the pointing operation and may accordingly increase the accuracy and robustness of the determined angles.

If the remote is not held flat (i.e. parallel to the ground plane) but is rotated around the x-axis ('rolled') during the pointing procedure, inaccurate results may occur, since the output from the gyroscopes and/or accelerometers is relative to the remote control's frame of reference rather than the earth's (and loudspeakers') frame of reference. This can be addressed by adding a gyroscope measuring angular rate around the remote control's x-axis, and/or an accelerometer measuring acceleration in the remote control's vertical z-direction (the latter method uses the always present gravity force as a reference).

If the remote is not held flat (i.e. parallel to the ground plane) but is tilted around the y-axis during the pointing procedure, inaccurate results may also occur. This can be solved by adding a gyroscope measuring angular rate around the remote's y-axis, and/or an accelerometer measuring acceleration in the remote control's vertical direction.

This approach may also address scenarios wherein the loudspeakers are not located in the same horizontal plane.

In the previous examples, additional sensors are used to account for the fact that the remote control may not be held horizontally all the time. To be able to correct for this, the roll and/or tilt data can be tracked continuously and the resulting calculation of the trajectories may become quite complicated and/or inaccurate. Another possibility is simply to instruct the user to hold the remote control horizontally during the calibration process and simply assume that this is the case when calculating the trajectories. Optionally, the additional sensors may be included but only used to detect that the remote control is tilted and/or rolled more than a given amount. If this is detected during the calibration process the calibration may be aborted and otherwise the calibration process may be considered to be sufficiently accurate.

An advantage of the described approach is that when one of the loudspeakers is moved to a different position after the calibration process, only the position of this loudspeaker needs to be recalibrated. Similarly, when the preferred listening position changes, the only thing that needs to be recalibrated is the listening position. For example, in one of the embodiments that include accelerometers for measuring translation, this can be done by performing a calibration procedure that consists of moving from the old listening position to the new one.

In some embodiments, the system may further support the provision of a user input indicating that a loudspeaker position is unused. In this case, the system may designate the corresponding speaker position as unused. This may be used to adapt the audio system to compensate for this speaker not being present. For example, if a surround speaker is not included, some of the audio from the surround channel may be fed through the front speakers.

Thus, in some embodiments, the user may have the option to indicate that he does not want to use one or more of the loudspeakers, e.g. by pressing a "don't use" button when he is asked to walk/point towards this loudspeaker. Accordingly, the user is able to indicate that he only wants to use a subset of the speakers thereby enabling the user e.g. to use the non-selected loudspeakers for a different purpose or to temporarily disable one of the loudspeakers e.g. if another person is seated very close to it.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A system for determining loudspeaker position estimates in a setup of surround sound loudspeakers, the system comprising:

means for determining motion data of a user movable unit that characterizes a movement of the user movable unit to be associated with a loudspeaker position of a corresponding loudspeaker in the setup;

a user input for receiving user activations that indicate, respectively, for each loudspeaker in the setup, that (i) a current position and (ii) a current orientation of the user movable unit is associated with the loudspeaker position of a corresponding loudspeaker in the setup in response to receiving a respective user activation of the received user activations; and analyzing means for generating loudspeaker position estimates for the loudspeakers in the setup in response to (i) the determined motion data of the user movable unit and (ii) the received user activations, wherein the user movable unit comprises a motion detection sensor and the determining means is arranged to determine the motion data in response to data from the motion detection sensor, wherein the motion detection sensor comprises at least one of:

a gyroscope;

an accelerometer; and a magnetometer.

2. The system of claim 1, wherein the analyzing means is arranged to determine orientation data, indicative of an orientation of the user movable unit, in response to the determined motion data.

3. The system of claim 2, wherein the analyzing means is arranged to estimate a direction from the current position of the user movable unit to a respective loudspeaker position for each of a plurality of user activations in response to orientation data for the user activations; and to determine the loudspeaker position estimates further in response to the directions.

4. The system of claim 2, wherein the analyzing means is arranged to determine the loudspeaker position estimates further in response to a predetermined distance estimate from the current position of the user movable unit to each respective loudspeaker position.

5. The system of claim 1, wherein the analyzing means is arranged to determine position data indicative of the current position of the user movable unit in response to the determined motion data.

6. The system of claim 5, wherein the analyzing means is arranged to estimate a relative position of the user movable unit for each of a plurality of user activations in response to the position data associated with the user activations, and to determine the loudspeaker position estimates further in response to the relative positions.

7. The system of claim 6, wherein the loudspeaker position estimates are determined in which each relative position corresponds to a respective position of a loudspeaker in the setup.

8. The system of claim 1, wherein the user input is arranged to receive a reference user activation indicating that the current position or orientation of the user movable unit is associated with a listening position reference, and wherein the analyzing means is arranged to determine a reference position or orientation in response to the reference user activation, and to determine the loudspeaker position estimates further in response to the reference position or orientation.

9. The system of claim 8, wherein the analyzing means is further arranged to determine the loudspeaker position estimates relative to the listening position reference.

10. The system of claim 1, wherein the user input is further arranged to receive a user input indicating that a loudspeaker position in the setup is unused; and wherein the analyzing means is further arranged to designate a corresponding loudspeaker position in the setup as unused.

11. The system of claim 1, wherein the user movable unit comprises a handheld device.

12. The system of claim 1, wherein the user movable unit is arranged to determine at least one of (i) a position estimate and (ii) an orientation estimate for the user movable unit at a time of user activation; and wherein the user movable unit further comprises means for communicating the at least one of (i) the position estimate and (ii) the orientation estimate to a remote unit.

13. The system of claim 1, further comprising means for causing a sound signal to be radiated from a first loudspeaker position to be estimated; and means for linking a user activation received within a time interval associated with the sound radiation to the first loudspeaker position.

14. A method of determining loudspeaker position estimates in a setup of surround sound loudspeakers, the method comprising:

determining motion data of a user movable unit that characterizes a movement of the user movable unit to be associated with a loudspeaker position of a corresponding loudspeaker in the setup;

receiving user activations that indicate, respectively, for each loudspeaker in the setup, that (i) a current position and (ii) a current orientation of the user movable unit is associated with the loudspeaker position of a corresponding loudspeaker in the setup in response to receiving a respective user activation of the received user activations; and generating loudspeaker position estimates for the loudspeakers in the setup in response to (i) the determined motion data of the user movable unit and (ii) the received user activations, wherein the user movable unit comprises a motion detection sensor and wherein determining further comprises determining the motion data in response to data from the motion detection sensor, wherein the motion detection sensor comprises at least one of:

a gyroscope;

an accelerometer; and a magnetometer.

* * * * *